US011132936B2

(12) United States Patent
Yeh et al.

(10) Patent No.: US 11,132,936 B2
(45) Date of Patent: Sep. 28, 2021

(54) PIXEL CIRCUIT AND DRIVING METHOD

(71) Applicant: Lextar Electronics Corporation, Hsinchu (TW)

(72) Inventors: Chien-Nan Yeh, Hsinchu (TW); Jian-Chin Liang, Hsinchu (TW)

(73) Assignee: Lextar Electronics Corporation, Hsinchu (TW)

( * ) Notice: Subject to any disclaimer, the term of this patent is extended or adjusted under 35 U.S.C. 154(b) by 0 days.

(21) Appl. No.: 16/672,510

(22) Filed: Nov. 3, 2019

(65) Prior Publication Data

US 2021/0043129 A1 Feb. 11, 2021

(30) Foreign Application Priority Data

Aug. 6, 2019 (TW) ..... 108127946

(51) Int. Cl.
*G09G 3/30* (2006.01)
*G09G 3/20* (2006.01)

(52) U.S. Cl.
CPC ..... *G09G 3/30* (2013.01); *G09G 3/2003* (2013.01); *G09G 2320/064* (2013.01)

(58) Field of Classification Search
None
See application file for complete search history.

(56) References Cited

U.S. PATENT DOCUMENTS

| | | | | |
|---|---|---|---|---|
| 2009/0062617 | A1 | 3/2009 | Mizuyoshi | |
| 2013/0169172 | A1* | 7/2013 | Kesterson | H05B 45/37 315/186 |
| 2017/0188427 | A1 | 6/2017 | Cok et al. | |
| 2019/0114991 | A1* | 4/2019 | Selan | G09G 5/026 |

FOREIGN PATENT DOCUMENTS

| | | | |
|---|---|---|---|
| CN | 101932159 | A | 12/2010 |
| CN | 101938877 | A | 1/2011 |
| CN | 102770899 | A | 11/2012 |
| CN | 104252847 | A | 12/2014 |
| TW | 201445539 | A | 12/2014 |
| TW | 201914003 | A | 4/2019 |

* cited by examiner

*Primary Examiner* — Robin J Mishler
(74) *Attorney, Agent, or Firm* — CKC & Partners Co., LLC

(57) ABSTRACT

The present disclosure relates to a pixel circuit including a light emitting unit, a processing circuit and a driving circuit. The processing circuit is configured to receive a frame display signal, and is configured to calculate the frame display signal to generate a driving duty cycle corresponding to a driving period according to a driving current value. The driving circuit is electrically connected to the processing circuit and the light emitting unit, and is configured to drive the light emitting unit during the driving period according to the driving duty cycle, the driving current value and a driving frequency.

8 Claims, 6 Drawing Sheets

PIXEL CIRCUIT AND DRIVING METHOD

CROSS-REFERENCE TO RELATED APPLICATION

This application claims priority to Taiwan Application Serial Number 108127946, filed Aug. 6, 2019, which is herein incorporated by reference in its entirety.

BACKGROUND

Technical Field

The present disclosure relates to a pixel circuit and a driving method, the pixel circuit drives a light emitting unit during a driving period according to a driving duty cycle, a driving current value and a driving frequency.

Description of Related Art

A light emitting diode (LED) is a light-emitting device that is driven by current, and its brightness changes with the magnitude of the driving current. There are two driving methods for the light emitting diode. One is to control the drive current to an average value (hereinafter referred to as "average current") so that the average current corresponds to the expected brightness. The other is to transmit multiple pulse current signals using the Pulse Width Modulation method during a driving period (hereinafter referred to as "PWM current"), and to control the expected brightness by controlling the duty cycle of the LED during the driving period.

However, both of the above driving methods are not perfect. FIG. 1A is a schematic diagram of an "average current" driving method. The LED emits different brightness depending on the different current. For example, in the first display period $F_a$, the first driving current $I_a$ passes through the LED to emit a first brightness. If the second driving current $I_b$ (less than the first driving current Ia) passes through the LED in the second display period $F_b$, the second brightness emitted by the LED is less than the first brightness. However, if the second driving current $I_b$ is too small, the wavelength of the light emitted by the LED will be shifted, so that the color of the light emitted by the LED is not as expected. Therefore, the "average current" driving method does not accurately control the LED to produce different brightness.

On the other hand, FIG. 1B is a schematic diagram of a "PWM current" driving method. The LEDs are driven by the same magnitude of the pulse current signal $I_c$, and emit different brightness depending on the enable times $T_a$, $T_b$ of the pulse current signal $I_c$. However, since a display device using a "PWM current" driving method generally sequentially drives multiple rows of LEDs in one period through multiple scanning lines, each LED has a limited driving time. That is, in one display period, the N rows of LEDs are sequentially driven, so the driving time of the LEDs of each row will be only one-N of the display period. As shown in FIG. 1B, in the first display period $F_a$, the control circuit drives only one LED at the enable time $T_a$ of the pulse current signal $I_c$. The rest of the time is used to drive other LEDs. Since the driving time of the LED is short, the pulse current signal must be increased in order to generate sufficient brightness. By increasing the current, the shortcomings of "the driving time is too short" may be compensated. Comparing FIG. 1A and FIG. 1B, the current value of the pulse current signal Ic of the "PWM current" driving method will be much larger than the first driving current Ia or the second driving current Ib in the "average current" driving method.

As mentioned above, the "PWM current" drive method requires a large current to be a disadvantage in control because the design trend of LEDs is toward "miniature". For example, the Micro LED technology can reduce the size of a LED to 100 microns. In the case of miniaturization of the LED, the current withstand range of the LED also becomes lower as the volume decreases. Therefore, the "PWM current" driving method is obviously not suitable for current or future LED products, and the "average current" driving method is also not applicable because of the problem of wavelength shift at low current.

Referring to FIG. 1C, a control circuit 100 for LED includes a signal processing circuit 110, a driving circuit 120 and multiple LEDs 131-133. The LEDs 131-133 are used to display the same pixel in the picture. For example, the LEDs 131-133 generate red light, green light, and blue light, respectively. The signal processing circuit 110 is used to simultaneously transmit the pulse current signal to the LEDs 131-133 during the display period, so that the LEDs 131-133 emits corresponding brightness according to the enable time of the pulse current signal. Since the signal processing circuit 110 is only used to drive the LEDs 131-133 representing a single pixel, the driving time of the LEDs 131-133 is equal to the display period, and there is no problem that the "driving time is too short" in the above "PWM current" driving method.

However, the circuit shown in FIG. 1C is still not ideal because the electrical characteristics of each LED are not exactly the same. If the driving time ratio is adjusted only according to the driving principle of the "PWM current" driving method, and the driving current is not adjusted, the LEDs 131-133 will not operate at the ideal luminous efficiency value. That is, the circuit shown in FIG. 1C is still limited by the limitations of the PWM technology, and the magnitude of the drive current cannot be adjusted, so that LEDs 131-133 unable to operate at the ideal luminous efficiency value, so the improvement of the above method is still very limited.

SUMMARY

One aspect of the present disclosure is a driving method, including the following steps. Providing a light emitting unit. Receiving a frame display signal through a processing circuit. Calculating the frame display signal to generate a driving duty cycle corresponding to a driving period according to a driving current value. Driving the light emitting unit during the driving period according to the driving duty cycle, the driving current value and a driving frequency.

Another aspect of the present disclosure is a pixel circuit, including a light emitting unit, a processing circuit and a driving circuit. The processing circuit is configured to receive a frame display signal, and is configured to calculate the frame display signal to generate a driving duty cycle corresponding to a driving period according to a driving current value. The driving circuit is electrically connected to the processing circuit and the light emitting unit, and is configured to drive the light emitting unit during the driving period according to the driving duty cycle, the driving current value and a driving frequency.

Another aspect of the present disclosure is a pixel circuit, including a light emitting unit, a processing circuit and a driving circuit. The light emitting unit includes a first emitting subunit, a second emitting subunit and a third emitting subunit. The processing circuit is configured to a frame display signal. The frame display signal includes a first original duty cycle corresponding to the first emitting subunit, a second original duty cycle corresponding to the second emitting subunit, and a third original duty cycle corresponding to the third emitting subunit. The processing circuit is further configured to respectively calculate the first original duty cycle, the second original duty cycle and the third original duty cycle to generate a first driving duty cycle corresponding to the first emitting subunit, a second driving duty cycle corresponding to the second emitting subunit and a third driving duty cycle corresponding to the third emitting subunit according to a first driving current value, a second driving current value and a third driving current value. The driving circuit is electrically connected to the processing circuit and the light emitting unit, and is configured to drive the first emitting subunit, the second emitting subunit and the third emitting subunit during a driving period according to the first driving current value, the second driving current value, the third driving current value, the first driving duty cycle, the second driving duty cycle and the third driving duty cycle.

It is to be understood that both the foregoing general description and the following detailed description are by examples, and are intended to provide further explanation of the disclosure as claimed.

BRIEF DESCRIPTION OF THE DRAWINGS

The present disclosure can be more fully understood by reading the following detailed description of the embodiment, with reference made to the accompanying drawings as follows.

DETAILED DESCRIPTION

For the embodiment below is described in detail with the accompanying drawings, embodiments are not provided to limit the scope of the present disclosure. Moreover, the operation of the described structure is not for limiting the order of implementation. Any device with equivalent functions that is produced from a structure formed by a recombination of elements is all covered by the scope of the present disclosure. Drawings are for the purpose of illustration only, and not plotted in accordance with the original size.

It will be understood that when an element is referred to as being "connected to" or "coupled to", it can be directly connected or coupled to the other element or intervening elements may be present. In contrast, when an element to another element is referred to as being "directly connected" or "directly coupled," there are no intervening elements present. As used herein, the term "and/or" includes an associated listed items or any and all combinations of more.

Figure 1A:
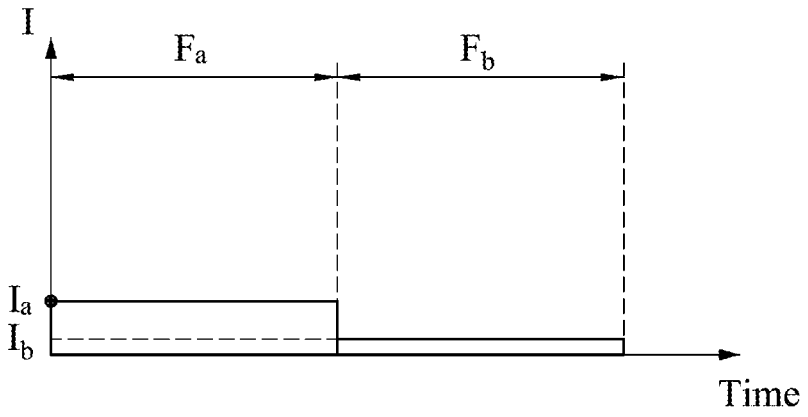
Fig. 1A ( PRIOR ART )
FIG. 1A is a current waveform diagram of driving a light-emitting diode with an average current.
Figure 1B:
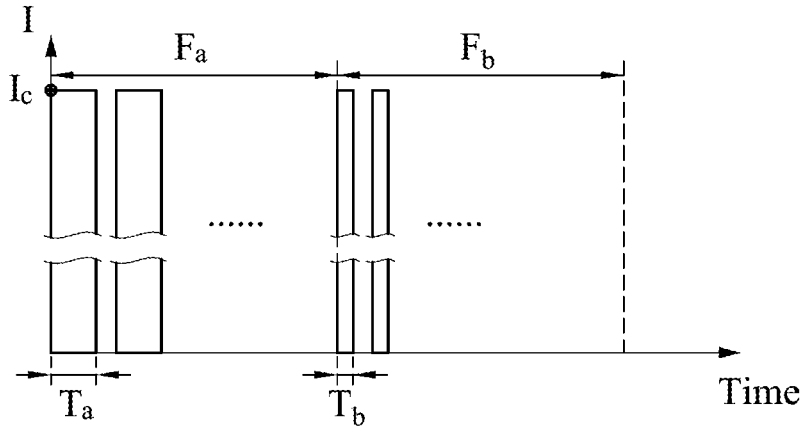
Fig. 1B ( PRIOR ART )
FIG. 1B is a current waveform diagram of driving a light-emitting diode with a PWM current.
Figure 1C:
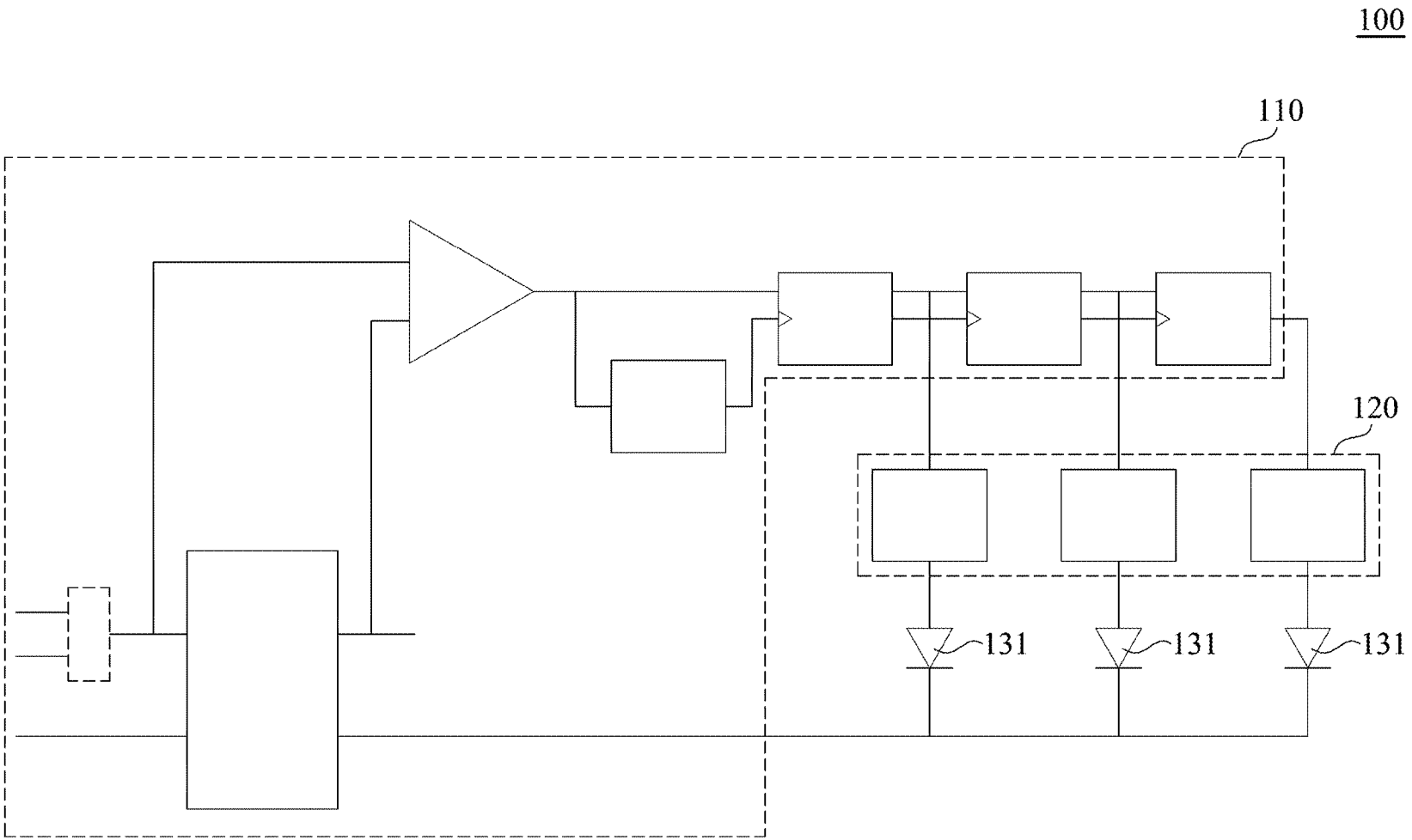
Fig. 1C ( PRIOR ART )
FIG. 1C is a schematic diagram of a control circuit.
Figure 2:
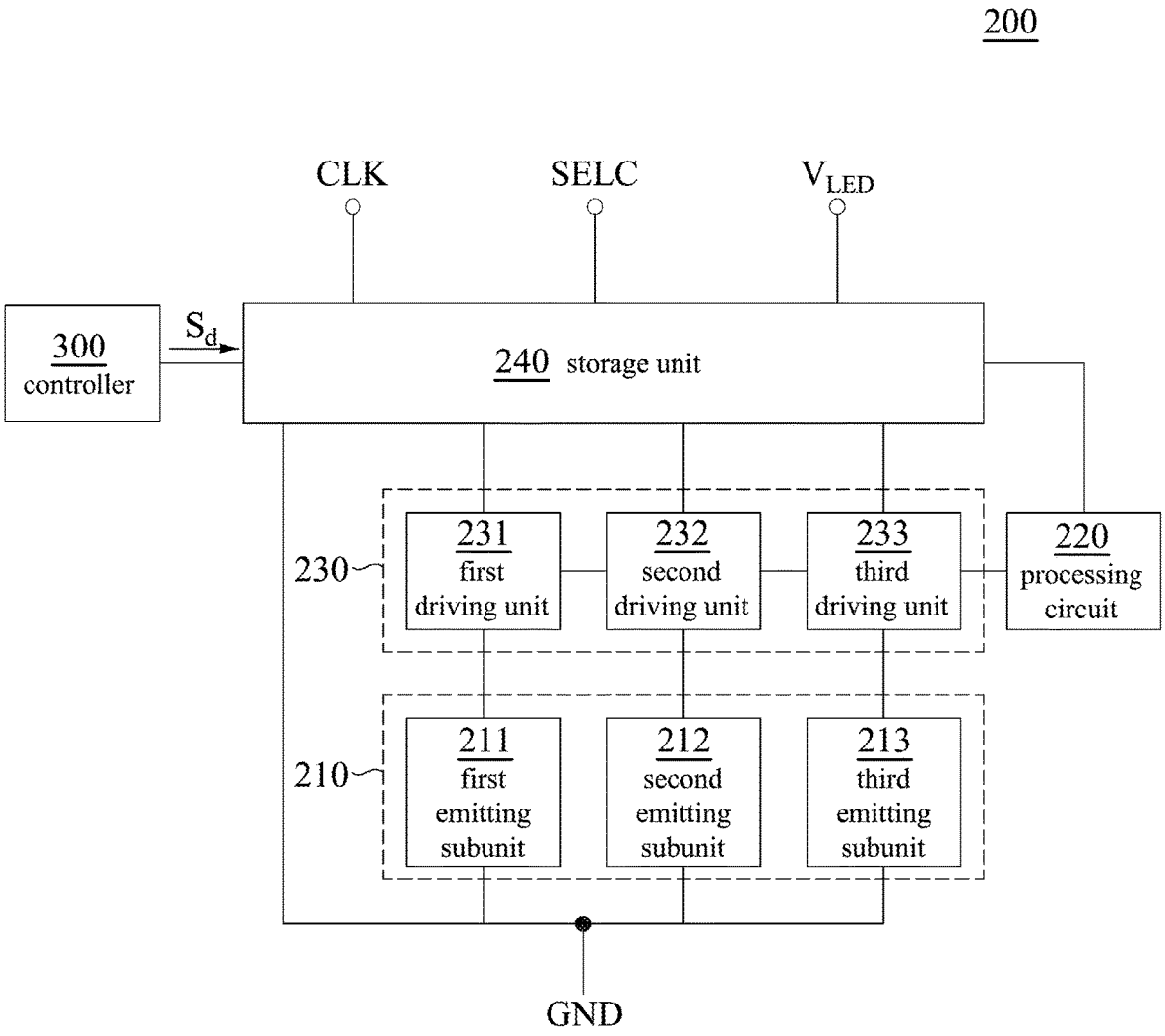
FIG. 2 is a schematic diagram of a pixel circuit in some embodiments of the present disclosure.

Refer to FIG. 2, FIG. 2 is a schematic diagram of a pixel circuit 200 in some embodiments of the present disclosure. The pixel circuit 200 is arranged in a display device and is electrically connected to a controller 300 of the display device. The pixel circuit 200 includes a light emitting unit 210, a processing circuit 220 and a driving circuit 230. The light emitting unit 210 includes at least one emitting subunit and is electrically connected to a reference potential GND (e.g., zero potential). In some embodiments, the light emitting unit 210 includes a first emitting subunit 211, a second emitting subunit 212 and a third emitting subunit 213 to respectively emit red light, green light and blue light.

The processing circuit 220 is configured to receive a frame display signal $S_d$ transmitted by the controller 300. The pixel circuit 200 will drive the light emitting unit 210 according to the frame display signal $S_d$ to emit light includes a gray scale signal. In some embodiments, the frame display signal $S_d$ includes a original duty cycle, and the original duty cycle corresponds to a gray scale value. In some embodiments, "the original duty cycle" means a length of time that the light emitting diode (e.g., the light emitting unit 210) is turned on by the pulse current signal when the controller 300 transmits the pulse current signal according to the PWM technology (e.g., Duty cycle, or the length of time that the light emitting unit is turned on).

In this embodiment, the processing circuit 220 controls the driving circuit 230 to transmit a pulse current signal to drive the light emitting unit 210, but the driving method of this embodiment is different from the "PWM current" driving method. After the processing circuit 220 receives the frame display signal $S_d$, the processing circuit 220 first calculates the frame display signal $S_d$ according to "the driving current value" to generate a driving duty cycle correspondence to the driving period. Then, the processing circuit 220 generates a pulse current signal according to "the driving frequency". The operation of the processing circuit 220 calculates the driving duty cycle will be described in detail in the subsequent paragraphs.

In other words, the present disclosure converts the frame display signal $S_d$ to generate a pulse current signal, which corresponds to "the driving current value" and "the driving frequency", and generate a "the driving duty cycle" of the pulse current signal, instead of directly generating a pulse current signal according to the frame display signal $S_d$.

"The driving current value" is the preset current when driving the light emitting unit 210. The "the driving frequency" is the preset number of the light emitting unit 210 is turned on in one driving period. In some embodiments, The controller 300 of the display device sets the driving current value and the driving frequency to the processing circuit 220 according to the electrical characteristics of the light emitting unit 210, but the present disclosure is not limited thereto. In other embodiments, the processing circuit 220 can obtain "the driving current value" and "the driving frequency" from other circuits.

In some embodiments, the processing circuit 220 is configured to perform various operations, and can be implemented by a microcontroller, a microprocessor, a digital signal processor, an application specific integrated circuit (ASIC) or a logic circuit.

The driving circuit 230 is electrically connected to the processing circuit 220 and the light emitting unit 210, for receiving the processing signal transmitted by the processing circuit 220 (wherein the processing signal includes the driving duty cycle, the driving current value and the driving frequency), and configured to drive the light emitting unit 210 according to the driving duty cycle, the driving current value, and the driving frequency during the driving period. The light emitting unit 210 may operate at the preferred luminous efficiency value under the driving conditions of the driving duty cycle, the driving current value and the driving frequency.

Figure 3:
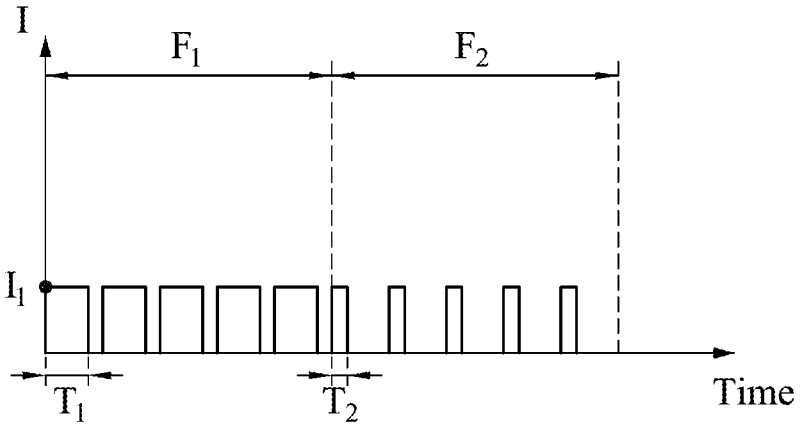
FIG. 3 is a current waveform diagram of a pixel circuit in some embodiments of the present disclosure.

Referring to FIG. 3, FIG. 3 is a current waveform diagram of a pixel circuit in some embodiments of the present disclosure. During the first driving period $F_1$, the driving circuit 230 transmits a pulse current signal multiple times to turn on the light emitting unit 210. The magnitude of the pulse current signal is the drive current $I_1$. The frequency of the pulsed current signal corresponds to the driving frequency (in FIG. 3, 5 times per period). The enable time $T_1$ of each pulse current signal is in response to the driving duty cycle (e.g., 80%). In the second driving period $F_2$, if the brightness is reduced, the enable time $T_2$ of each pulse current signal will be shortened to correspond to the different driving duty cycle (e.g., 55%). However, the driving current $I_1$ and the driving frequency during the first driving period and the second driving period $F_2$ are constant.

Accordingly, since the pixel circuit 200 is used to drive one light emitting unit 210 (i.e., a pixel, the pixel may be composed of multiple emitting subunits), the entire driving period $F_1$ or $F_2$ can be used as the driving time of the light emitting unit 210. The disclosure is different from the traditional "PWM current" driving method, which needs to display multiple different pixel brightness sequentially in one driving period. Therefore, it can solve the problem of excessive drive current.

In addition, because the driving current value and the driving frequency are set according to the electrical characteristics or display requirements of the light emitting unit 210 (the higher the times, the lower the probability of "flash" phenomenon), and the processing circuit 220 calculates the driving duty cycle according to the driving current value, the light emitting unit 210 may be driven in a more efficient state and emit the expected brightness.

In some embodiments, the pixel circuit 200 further includes the storage unit 240. The storage unit 240 is electrically connected to the controller 300, the processing circuit 220 and the driving circuit 230, and is configured to receive the frame display signal Sd, the clock signal CLK, the selection signal SELC and the power supply signal $V_{LED}$. The storage unit 240 is configured to provide the frame display signal $S_d$ to the processing circuit 220. After the processing circuit 220 receives the frame display signal $S_d$ from the storage unit 240, calculating and obtaining the driving duty cycle according to the frame display signal Sd. The driving circuit 230 receives the clock signal CLK, the selection signal SELC, and the power supply signal $V_{LED}$ through the storage unit 240, and cooperates with the driving duty cycle, the driving current value and the driving frequency to drive the light emitting unit 210.

The following describes the calculation of the driving duty cycle. In some embodiments, the frame display signal $S_d$ includes the original duty cycle corresponding to the gray scale valve. For example, the frame display signal $S_d$ includes a drive command that provides "2 milliampere" of current in "one-fiftieth of a period" to emit the brightness of the gray scale valve "95." This drive command is based on the above "PWM current" drive method. However, as mentioned above, the "PWM current" driving method needs to drive multiple light emitting units (e.g., 50 scanning lines) in one period, and there is a problem of excessive current. Therefore, the pixel circuit 200 of the present disclosure does not directly drive the light emitting unit 210 according to the frame display signal $S_d$.

The processing circuit 220 converts the "the original duty cycle" in the frame display signal $S_d$ into "the driving duty cycle" suitable for the driving method of the present disclosure. The conversion method is as follows: After the processing circuit 220 receives the frame display signal Sd, the processing circuit 220 determines that the average current corresponding to the frame display signal $S_d$ is 40 microamperes (2 mA is divided by 50). Then, the processing circuit 220 calculates that the driving duty cycle is 80% (because) according to the preset driving current value (for example, 50 uA, and 50×0.8=40). The processing circuit 220 generates the pulse current signal to drive the light emitting unit 210 according to the driving frequency (e.g., 5 times) set in advance, the calculated driving duty cycle and the driving current. Accordingly, the light emitting unit 210 may operate in a safe and more efficient working state.

Figure 4:
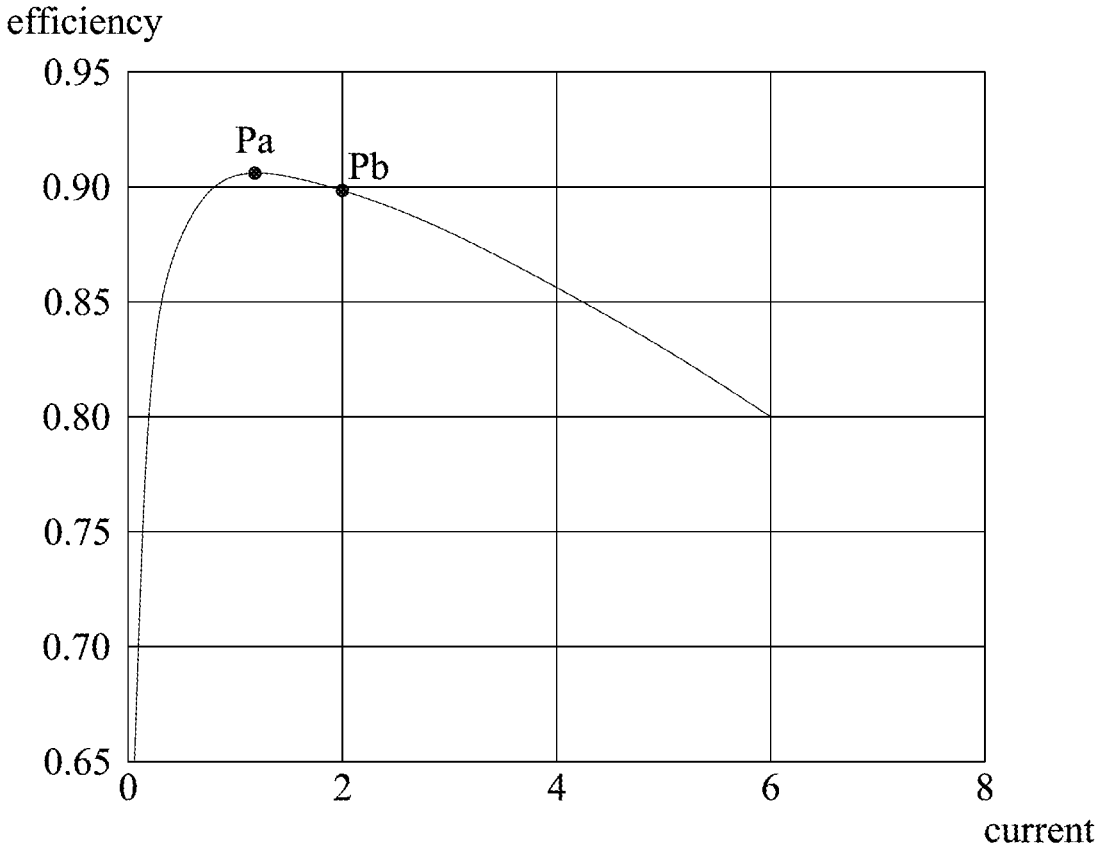
FIG. 4 is a characteristic diagram of the current and luminous efficiency of the light-emitting diode in some embodiments of the present disclosure.

FIG. 4 is the current characteristic curve of the light emitting unit 210 (e.g., LED). The horizontal axis is the driving current of the light emitting unit 210. The vertical axis is the luminous efficiency value. According to the current characteristic curve, the characteristic of "current-the luminous efficiency value" is not linear, and has the largest luminous efficiency value at a specific current value. For example, at the operating point Pa, the driving current is 1 milliampere, the luminous efficiency value 0.91. At operating point Pb, the drive current is 2 milliampere, but the luminous efficiency value is reduced to 0.90. In some embodiments, the processing circuit 220 obtains the luminous efficiency value corresponding to the driving current value according to the current characteristic curve of the light emitting unit 210, and calculates the frame display signal according to the luminous efficiency value, the driving current value, and the driving frequency, so that the processing circuit 220 obtains the driving duty cycle to emit an expected brightness when the light emitting unit 210 operates on the luminous efficiency value. In another embodiment, the processing circuit 220 obtains the ideal current value (e.g., the operating point Pa shown in FIG. 4) having the highest luminous efficiency value according to the current characteristic curve, and set the ideal current value having the highest luminous efficiency value as the driving current value.

Figure 5:
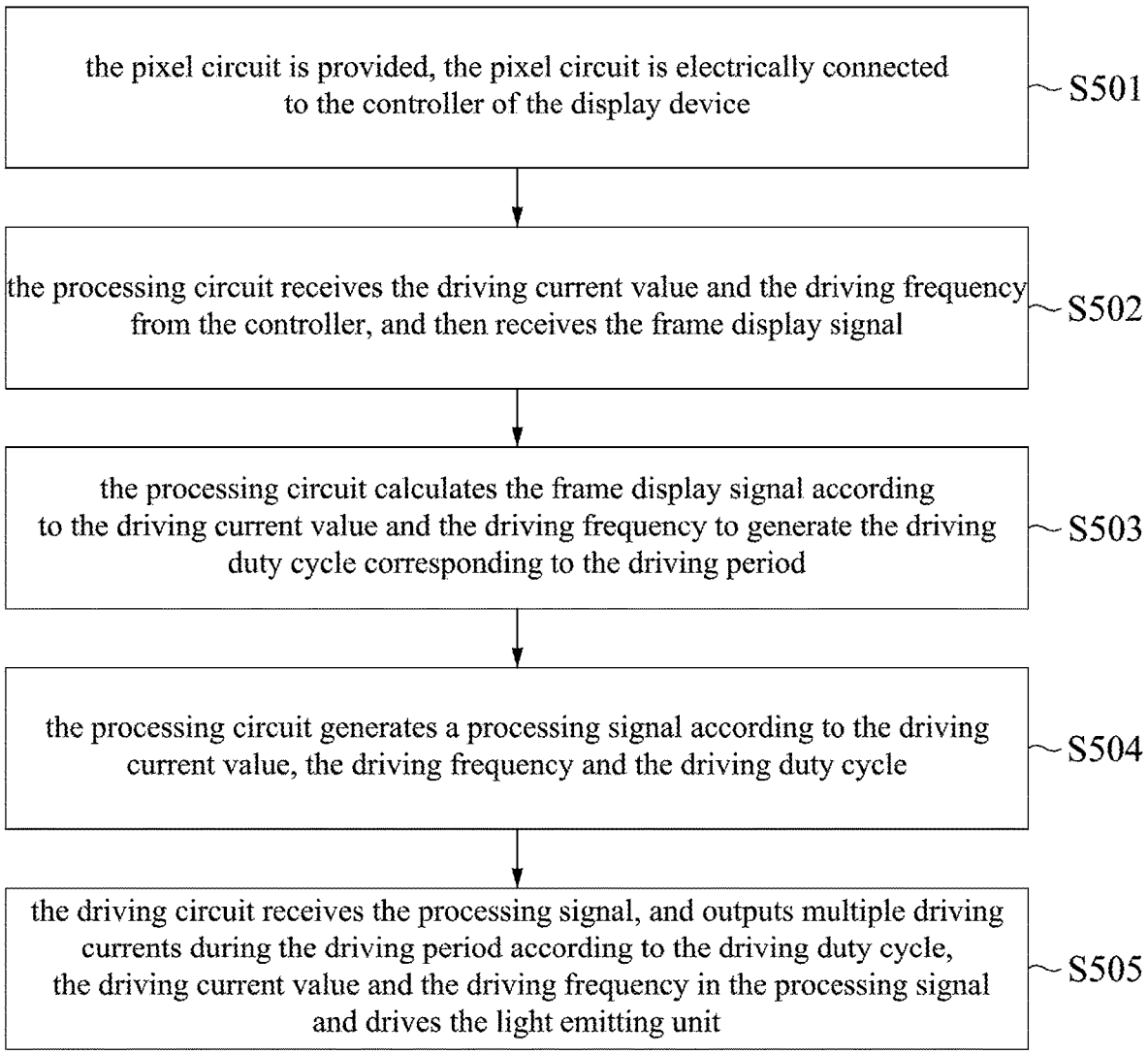
FIG. 5 is a flowchart illustrating a driving method in some embodiments of the present disclosure.

Referring to FIG. 5, FIG. 5 is a flowchart illustrating a driving method in some embodiments of the present disclosure. In the step S501, the pixel circuit 200 is provided, so that the pixel circuit 200 is electrically connected to the controller 300 of the display device. The pixel circuit 200 includes the processing circuit 220, the driving circuit 230, the storage unit 240 and the light emitting unit 210.

In the step S502, the processing circuit 220 receives the driving current value and the driving frequency from the controller 300, and then receives the frame display signal Sd. In some embodiments, the controller 300 stores the driving current value and the driving frequency in the storage unit 240 in advance. Then, the processing circuit 220 obtains the driving current value and the driving frequency from the storage unit 240. In other embodiments, the processing circuit 220 can simultaneously receive the frame display signal $S_d$, the driving current value and the driving frequency from the controller 300 during the driving period.

In the step S503, the processing circuit 220 calculates the frame display signal according to the driving current value to generate the driving duty cycle corresponding to the driving period. In some embodiments, the frame display signal Sd includes the original duty cycle corresponding to the gray scale valve. The processing circuit 220 calculates the original duty cycle to generate the driving duty cycle corresponding to the gray scale valve according to the driving current value, the driving frequency.

In the step S504, the processing circuit 220 generates a processing signal according to the driving current value, the driving frequency and the driving duty cycle, and transmits the processing signal to the light emitting unit 210. As shown in FIG. 2, in some embodiments, the light emitting unit 210 includes the first emitting subunit 211, the second emitting subunit 212 and the third emitting subunit 213. The processing circuit 220 is respectively calculated to obtain the corresponding driving duty cycles according to different emitting subunits 211-213.

In the step S505, the driving circuit 230 receives the processing signal, and outputs multiple driving currents during the driving period according to the driving duty cycle, the driving current value and the driving frequency in the processing signal and drives the light emitting unit 210.

As mentioned above, in some embodiments, the processing circuit 220 or the controller 300 further obtains the luminous efficiency value corresponding to the driving current value according to the current characteristic curve of the light emitting unit 210. Then, the processing circuit 220 or the controller 300 calculates the frame display signal $S_d$ to generate the driving duty cycle according to the luminous efficiency value, the driving current value and the driving frequency. The processing circuit 220 or the controller 300 may set an ideal current having the highest luminous efficiency value of the current characteristic curve as the driving current value.

In the above embodiments, the driving method is described only by "the driving circuit" and "the light emitting unit". In other embodiments, the light emitting unit 210 may include multiple emitting subunits, and the driving circuit 230 may also include multiple corresponding driving circuits. As shown in FIG. 2, in some embodiments, the light emitting unit 210 includes a first emitting subunit 211, a second emitting subunit 212 and a third emitting subunit 213. The first emitting subunit 211 (e.g., red light emitting diode) is configured to emit red light. The second emitting subunit 212 (e.g., green light emitting diode) is configured to emit green light. The third emitting subunit 213 (e.g., blue light emitting diode) is configured to emit blue light. The driving circuit 230 includes a first driving unit 231, a second driving unit 232 and a third driving unit 233 for respectively driving the first emitting subunit 211, the second emitting subunit 212 and the third emitting subunit 213.

In some embodiments, the first emitting subunit 211 includes a blue light emitting diode and a red wavelength conversion material. The red wavelength conversion material includes red quantum dots and red phosphor powder, or a combination of red quantum dots and red phosphor powder. The second emitting subunit 212 includes a blue light emitting diode and a green wavelength conversion material. The green wavelength conversion material includes green quantum dot and green fluorescent powder, or a combination of green quantum dots and green fluorescent powder. The third emitting subunit 213 includes a blue light emitting diode and a blue wavelength conversion material for emitting blue light. The blue wavelength conversion material includes blue fluorescent powder and blue quantum dots, or a combination of blue fluorescent powder and blue quantum dots. In one embodiment, the light emitting unit 210 further includes a fourth emitting subunit (not shown) to emit other color lights. The fourth emitting subunit can be paired with the first emitting subunit 211, the second emitting subunit 212 and the third emitting subunit 213. For example, the fourth emitting subunit includes a blue light emitting diode and a yellow wavelength conversion material for emitting yellow light. The yellow wavelength conversion material includes yellow fluorescent powder and yellow quantum dots, or a combination of yellow fluorescent powder and yellow quantum dots. Furthermore, the light emitting diode can be implemented by a light emitting diode chip, a mini LED chip, or a micro LED chip.

In this embodiment, the frame display signal Sd includes the first original duty cycle corresponding to the first emitting subunit 211, the second original duty cycle corresponding to the second emitting subunit 212 and the third original duty cycle corresponding to the third emitting subunit 213. the processing circuit 220 calculates the first original duty cycle to generate the first driving duty cycle corresponding to the first emitting subunit 211 according to the first driving current value. Similarly, the processing circuit 220 calculates the second original duty cycle to generate the second driving duty cycle corresponding to the second emitting subunit 212 according to the second driving current value. The processing circuit 220 calculates the third original duty cycle to generate the third driving duty cycle corresponding to the third emitting subunit 213 according to the third driving current value.

In some embodiments, the first driving unit 231 is configured to drive the first emitting subunit 211 during the driving period according to the first driving current value, the first driving duty cycle and the first driving frequency. The second driving unit 232 is configured to drive the second emitting subunit 212 during the driving period according to the second driving current value, the second driving duty cycle and the second driving frequency. The third driving unit 233 is configured to drive the third emitting subunit 213 during the driving period according to the third driving current value, the third driving duty cycle, and the third driving frequency.

Accordingly, the driving circuit 230 simultaneously drives the first emitting subunit 211, the second emitting subunit 212 and the third emitting subunit 213 during the driving period according to the first driving current value, the second driving current value, the third driving current value, the first driving duty cycle, the second driving duty cycle and the third driving duty cycle.

In some embodiments, the driving current value and the driving frequency are set by the controller 300 to the storage unit 240 in advance. In other embodiments, the driving frequency is included in the frame display signal $S_d$, and the processing circuit 220 calculates to obtain the driving duty cycle only according to the driving current value. That is, the processing circuit 220 may not adjust the driving frequency, and calculate to obtain the driving duty cycle only according to the magnitude of the driving current value.

Figure 6:
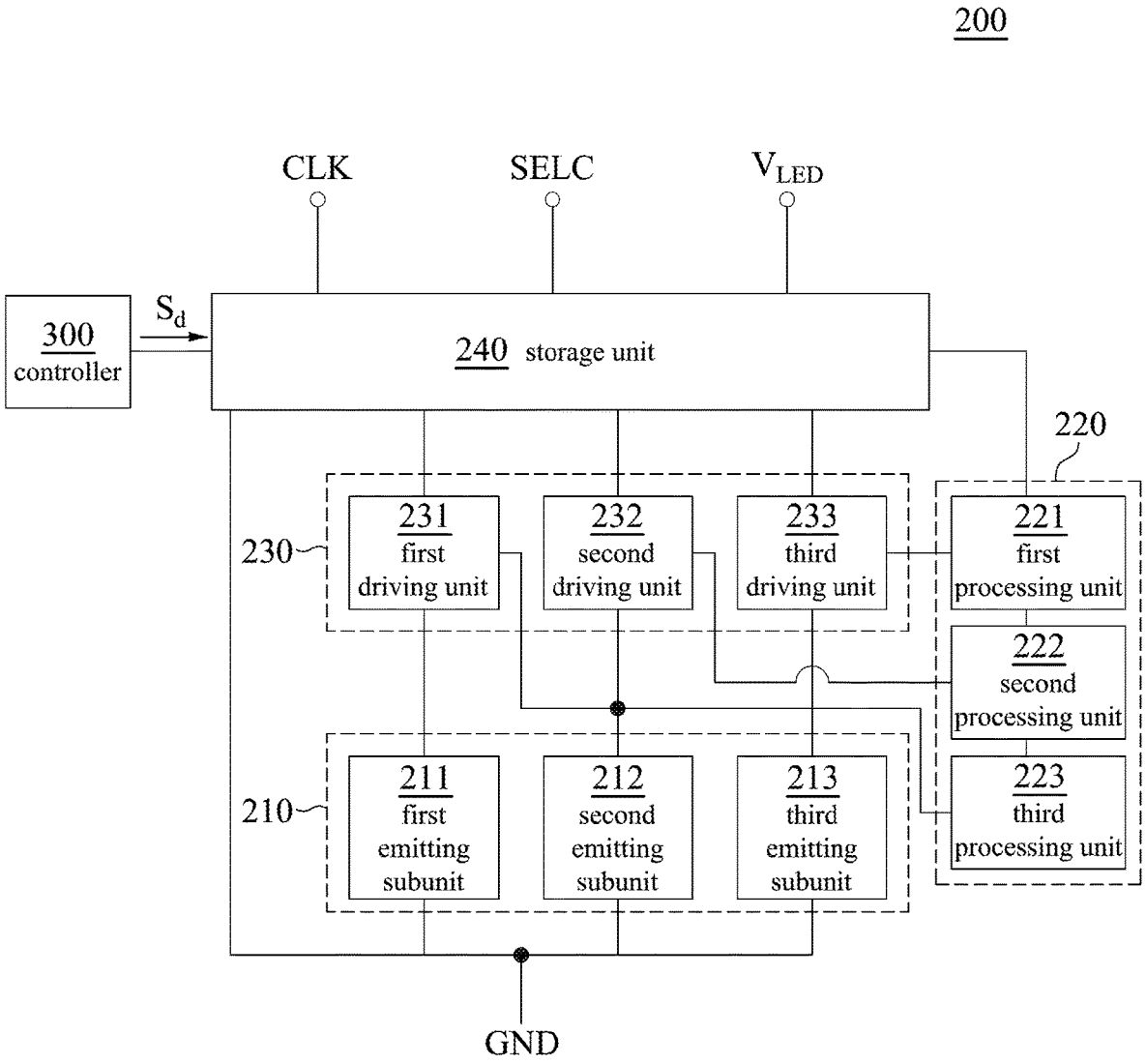
FIG. 6 is a schematic diagram of a pixel circuit in some embodiments of the present disclosure.

Referring to FIG. 6, FIG. 6 is a schematic diagram of a pixel circuit in some other embodiments of the present disclosure. In FIG. 6, the similar components associated with the embodiment of FIG. 2 are labeled with the same number for ease of understanding. The specific principle of the similar component has been explained in detail in the previous paragraphs, and unless it has a cooperative relationship with the components of FIG. 6, it is not repeated here.

In some embodiments, since the driving current and the driving frequency of each of the emitting subunits 211-213 may be different, the obtained driving duty cycles are also different. Therefore, the processing circuit 220 will calculate to obtain the driving duty cycle according to different processing units. As shown in FIG. 6, the processing circuit 220 includes a first processing unit 221, a second processing unit 222 and a third processing unit 223. The first processing unit 221 is electrically connected to the storage unit 240 and the first emitting subunit 211 so as to receive the frame display signal Sd. The first processing unit 221 calculates the first original duty cycle to generate the first driving duty cycle corresponding to the first emitting subunit 211 according to the first driving current value.

Similarly, the second processing unit 222 calculates the second original duty cycle to generate the second driving duty cycle corresponding to the second emitting subunit 212 according to the second driving current value. The third processing unit 223 calculates the third original duty cycle to generate the third driving duty cycle corresponding to the third emitting subunit 213 according to the third driving duty value.

The elements, method steps, or technical features in the foregoing embodiments may be combined with each other, and are not limited to the order of the specification description or the order of the drawings in the present disclosure.

It will be apparent to those skilled in the art that various modifications and variations can be made to the structure of the present disclosure without departing from the scope or spirit of the present disclosure. In view of the foregoing, it is intended that the present disclosure cover modifications and variations of this present disclosure provided they fall within the scope of the following claims.

What is claimed is:

1. A driving method, comprising:

providing a light emitting unit, wherein the light emitting unit comprises a first emitting subunit, a second emitting subunit and a third emitting subunit;

receiving a frame display signal through a processing circuit, wherein the frame display signal corresponds to an original duty cycle and an original current value;

calculating the frame display signal to generate a driving duty cycle corresponding to a driving period according to a driving current value, wherein the driving current value and the original current value are different;

driving the light emitting unit during the driving period to display a pixel according to the driving duty cycle, the driving current value and a driving frequency; and emitting red light by the first emitting subunit, emitting green light by the second emitting subunit, and emitting blue light by the third emitting subunit; wherein calculating the frame display signal to generate the driving duty cycle comprises:

calculating an average current value corresponding to the frame display signal according to the original current value; and calculating the driving duty cycle according to the driving current value and the average current value.

2. The driving method of claim 1, wherein generating the driving duty cycle comprises:

obtaining a luminous efficiency value according to a current characteristic curve of the light emitting unit.

3. The driving method of claim 1, further comprising:

setting an ideal current value having a highest luminous efficiency in a current characteristic curve of the light emitting unit as the driving current value.

4. The driving method of claim 1, further comprising:

storing the frame display signal to a storage unit; and obtaining the frame display signal from the storage unit through the processing circuit.

5. A pixel circuit, comprising:

a light emitting unit comprising a first emitting subunit, a second emitting subunit and a third emitting subunit, wherein the first emitting subunit is configured to emit red light, the second emitting subunit is configured to emit green light, and the third emitting subunit is configured to emit blue light;

a processing circuit configured to receive a frame display signal, and configured to calculate the frame display signal to generate a driving duty cycle corresponding to a driving period according to a driving current value, wherein the frame display signal corresponds to an original duty cycle and an original current value, the driving current value and the original current value are different; and a driving circuit electrically connected to the processing circuit and the light emitting unit, and configured to drive the first emitting subunit, the second emitting subunit and the third emitting subunit through a first driving unit, a second driving unit and a third driving unit to display a pixel during the driving period according to the driving duty cycle, the driving current value and a driving frequency, wherein the processing circuit is further configured to calculate an average current value corresponding to the frame display signal according to the original current value, and calculate the driving duty cycle according to the driving current value and the average current value.

6. The pixel circuit of claim 5, wherein the processing circuit is further configured to obtain a luminous efficiency value according to a current characteristic curve of the light emitting unit.

7. The pixel circuit of claim 5, wherein the driving current value is an ideal current value having a highest luminous efficiency in a current characteristic curve of the light emitting unit.

8. The pixel circuit of claim 5, further comprising:

a storage unit electrically connected to the processing circuit, and configured to provide the frame display signal to the processing circuit.

* * * * *